US009129559B2

(12) United States Patent
Park et al.

(10) Patent No.: US 9,129,559 B2
(45) Date of Patent: Sep. 8, 2015

(54) ORGANIC LIGHT EMITTING DISPLAY DEVICE AND DRIVING METHOD FOR THE SAME

(75) Inventors: Sung-Un Park, Yongin (KR); Kyoung-Soo Lee, Yongin (KR); Young-Hee Nam, Yongin (KR); Dong-Woo Lee, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 1001 days.

(21) Appl. No.: 12/686,854

(22) Filed: Jan. 13, 2010

(65) Prior Publication Data

US 2010/0245319 A1 Sep. 30, 2010

(30) Foreign Application Priority Data

Mar. 27, 2009 (KR) ..... 10-2009-0026475

(51) Int. Cl.
*G09G 5/00* (2006.01)
*G09G 3/32* (2006.01)

(52) U.S. Cl.
CPC ..... *G09G 3/3233* (2013.01); *G09G 2320/0673* (2013.01); *G09G 2330/021* (2013.01); *G09G 2330/028* (2013.01)

(58) Field of Classification Search
CPC ..... G09G 2330/021–2330/28; G09G 3/3233
USPC ..... 345/76–77, 211–212
See application file for complete search history.

(56) References Cited

U.S. PATENT DOCUMENTS 4,795,972 A 1/1989 Roppelt et al.
2003/0001815 A1* 1/2003 Cui ..... 345/102
2007/0146253 A1* 6/2007 Tang ..... 345/77

(Continued)

FOREIGN PATENT DOCUMENTS

CN 1825412 A 8/2006
CN 101312022 A 11/2008

(Continued)

OTHER PUBLICATIONS

KIPO Office action dated Nov. 15, 2010, for Korean priority Patent application 10-2009-0026475, noting listed references in this IDS, as well as JP 2007-171949, previously filed in an IDS dated Jan. 13, 2010.

(Continued)

*Primary Examiner* — Amare Mengistu
*Assistant Examiner* — Sarvesh J Nadkarni
(74) *Attorney, Agent, or Firm* — Christie, Parker & Hale, LLP

(57) ABSTRACT

An organic light emitting display device, and a driving method for the same. The organic light emitting display device, including: a pixel unit configured to display an image corresponding to a data signal, a scan signal, a first power, and a second power; a data driver configured to receive an image signal to output the data signal; a scan driver configured to output the scan signal; a power supply unit configured to receive an input power from an external source to generate the first power and the second power; and a controller configured to output a voltage control signal to control a voltage of the first power and a voltage of the second power and output a first gamma value and a second gamma value in accordance with a voltage of the input power, the first and second gamma values being for controlling a voltage of the data signal.

14 Claims, 3 Drawing Sheets

(56) References Cited

U.S. PATENT DOCUMENTS

| | | | | |
|---|---|---|---|---|
| 2008/0150930 | A1* | 6/2008 | Nam et al. | 345/212 |
| 2008/0316194 | A1* | 12/2008 | Morita | 345/211 |
| 2010/0164998 | A1* | 7/2010 | Li et al. | 345/690 |

FOREIGN PATENT DOCUMENTS

| | | | |
|---|---|---|---|
| EP | 1 978 506 | A2 | 10/2008 |
| JP | 2000-352703 | | 12/2000 |
| JP | 2004-023939 | | 1/2004 |
| JP | 2005-208228 | | 8/2005 |
| JP | 2007-171949 | | 7/2007 |
| JP | 2008-083085 | | 4/2008 |
| JP | 2008-286561 | | 11/2008 |
| KR | 10-2005-0021989 | | 3/2005 |
| KR | 1020060046635 | A | 5/2006 |
| KR | 10-2007-0040999 | | 4/2007 |
| KR | 10-0860718 | | 9/2008 |

OTHER PUBLICATIONS

Chinese Office action issued on Feb. 21, 2012 in corresponding Chinese Patent Application No. 201010143218.4, 6pp.

Japanese Office action issued on Mar. 27, 2012 in corresponding Japanese Patent Application No. 2009-289680, 3pp.

X-Phone Software, Inc, "Power Manager", www.xphonesoftware.com/pm.html, Nov. 18, 2008, XP-002590171.

Wikipdedia , "Median filter", http://en.wikipedia.org/w/index.php?title=Median_filter, Jul. 1, 2010, XP-002590507.

European Search Report dated Aug. 9, 2010, for corresponding European Patent application 10250592.2, noting listed references in this IDS.

KIPO Office Action for Korean Priority Patent Application No. 10-2009-0026475, dated Jul. 28, 2011, 1 page.

* cited by examiner

ORGANIC LIGHT EMITTING DISPLAY DEVICE AND DRIVING METHOD FOR THE SAME

CROSS-REFERENCE TO RELATED APPLICATIONS

This application claims priority to and the benefit of Korean Patent Application No. 10-2009-0026475, filed on Mar. 27, 2009, in the Korean Intellectual Property Office, the entire content of which is incorporated herein by reference.

BACKGROUND

1. Field of the Invention

The following description relates to an organic light emitting display device and a driving method for the same.

2. Discussion of Related Art

Recently, various flat panel display devices that are lighter in weight and smaller in volume, as compared with a cathode ray tube display device, have been developed. Among these flat panel display devices, there are a liquid crystal display device, a field emission display device, a plasma display panel display device, and an organic light emitting display device, etc.

The organic light emitting display device displays an image using organic light emitting diodes OLED that generate light by recombination of an electron and a hole.

The organic light emitting display device as described above has a high viewing angle, excellent color representation, thin thickness, etc., so that its application field has been expanded to PDAs, MP3s, etc., besides cellular phones.

FIG. 1 is a schematic circuit view showing a pixel adopted for an organic light emitting display device. Referring to FIG. 1, the pixel includes a first transistor M1, a second transistor M2, a capacitor Cst, and an organic light emitting diode OLED.

The source of the first transistor M1 is coupled to a first power supply ELVDD, the drain of the first transistor M1 is coupled to the anode electrode of the organic light emitting diode OLED, and the gate electrode of the first transistor M1 is coupled to a first node N1. In addition, the first transistor M1 allows driving current to be flowed from the source to the drain corresponding to the voltage of the first node N1.

The source of the second transistor M2 is coupled to a data line Dm, the drain of the second transistor M2 is coupled to the first node N1, and the gate electrode of the second transistor M2 is coupled to a scan line Sn. In addition, the second transistor M2 allows a data signal flowing on the data line Dm corresponding to a scan signal transferred through the scan line Sn to be transferred to the first node N1.

The first electrode of the capacitor Cst is coupled to the first power supply ELVDD, and the second electrode of the capacitor Cst is coupled to the first node N1 so that it allows the voltage of the first node N1 to be maintained even though the electrical coupling between the data line Dm and the first node N1 is blocked by the second transistor M2.

The organic light emitting diode OLED includes an anode electrode, a cathode electrode and an emission layer therebetween and light-emits light on the emission layer corresponding to the magnitude of the driving current that flows from the anode electrode to the cathode electrode. The cathode electrode is coupled to the second power supply ELVSS whose voltage is lower than that of the first power supply so that the current can be flowed from the anode electrode to the cathode electrode.

The pixel formed as described above light-emits light by receiving a first power (e.g., a voltage) of the first power supply ELVDD and a second power (e.g., a voltage) of the second power supply ELVSS from an external power source, such as a battery. In a portable device that receives and uses power from a battery such as a cellular phone and a PDA, etc., it is important to extend a battery use time.

SUMMARY OF THE INVENTION

An aspect of an embodiment of the present invention is directed toward an organic light emitting display device capable of extending battery use time, and a driving method for the same.

Another aspect of an embodiment of the present invention is directed toward an organic light emitting display device capable of providing usage stability and extending a battery use time, and a driving method for the same.

An embodiment of the present invention provides an organic light emitting display device. The organic light emitting display device includes: a pixel unit configured to display an image corresponding to a data signal, a scan signal, a first power, and a second power; a data driver configured to receive an image signal to output the data signal; a scan driver configured to output the scan signal; a power supply unit configured to receive an input power from an external source to generate the first power and the second power; and a controller configured to output a voltage control signal to control a voltage of the first power and a voltage of the second power and output a first gamma value and a second gamma value in accordance with a voltage of the input power, the first and second gamma values being for controlling a voltage of the data signal.

Another embodiment of the present invention provides a driving method for an organic light emitting display device. The driving method includes: generating a first power and a second power by utilizing an input power; sensing a voltage of the input power; setting a voltage of a data signal, the voltage of the data signal, when the voltage of the input power is higher than a set value, being higher than the voltage of the data signal when the voltage of the input power is lower than the set value; and controlling a voltage of the first power and a voltage of the second power in accordance with the voltage of the input power.

With the organic light emitting display device and the driving method for the same according to embodiments of the present invention, the voltage range of the driving power that generates the first power and the second power that are generated by the voltage output from the battery and are transferred to the pixel can be implemented to be wider, making it possible to extend the battery use time. Accordingly, a cellular phone, etc. to which the organic light emitting display device is applied can be used for a longer time period.

BRIEF DESCRIPTION OF THE DRAWINGS

The accompanying drawings, together with the specification illustrate exemplary embodiments of the present invention, and, together with the description, serve to explain the principles of the present invention.

DETAILED DESCRIPTION

Figure 1:
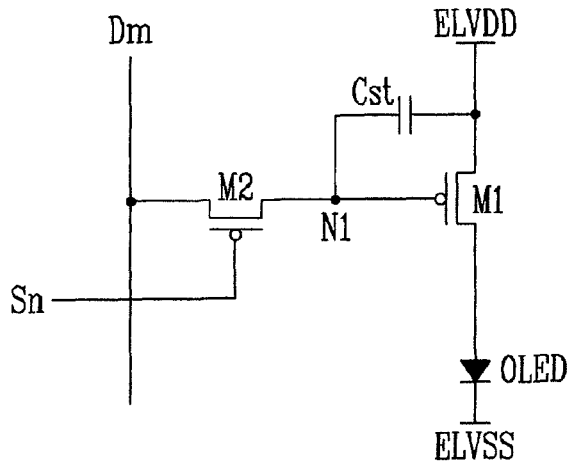
FIG. 1 is a schematic circuit diagram showing a pixel adopted to a general organic light emitting display device.

Hereinafter, certain exemplary embodiments according to the present invention will be described with reference to the accompanying drawings. Here, when a first element is described as being coupled to a second element, the first element may be not only directly coupled to the second element but may also be indirectly coupled to the second element via a third element. Further, some of the elements that are not essential to the complete understanding of the invention are omitted for clarity. Also, like reference numerals refer to like elements throughout.

Hereinafter, exemplary embodiments of the present invention will be described in more detail with reference to the accompanying drawings.

Figure 2:
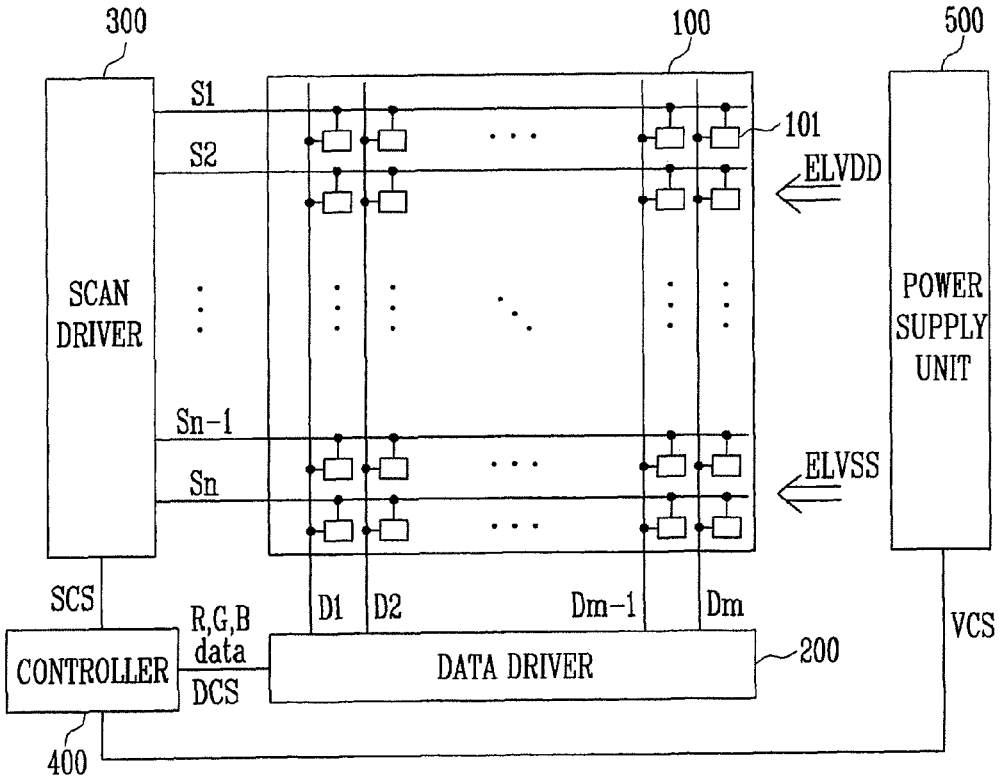
FIG. 2 is a schematic structure diagram showing an organic light emitting display device according to the present invention.

FIG. 2 is a schematic structure diagram showing an organic light emitting display device according to the present invention. Referring to FIG. 2, the organic light emitting display device includes a pixel unit (or display region) 100, a data driver 200, a scan driver 300, a controller 400, a power supply unit 500, and a battery.

The pixel unit 100 includes an organic light emitting diode on which a plurality of pixels 101 are arranged, wherein each pixel 101 light-emits light in accordance with the flow of current. In addition, the pixel unit 100 is arranged with n scan lines S1, S2, . . . Sn−1, and Sn that transfer scan signals in a row direction and m data lines D1, D2, . . . Dm−1, and Dm that transfer data signals in a column direction.

Also, the pixel unit 100 is driven by receiving a first power of a first power supply ELVDD and a second power of a second power supply ELVSS that has a lower level than the first power. Therefore, the pixel unit 100 is light-emitted by allowing current to be flowed onto the organic light emitting diode by the scan signals, the data signals, the first power of the first power supply ELVDD, and the second power of the second power supply ELVSS, thereby displaying an image.

The data driver 200 receives a data driving control signal DCS and an image signal R, G, and B data from the controller 400 to generate data signals. In addition, the data driver 200 applies the data signals generated by being coupled to the data lines D1, D2, . . . Dm−1, and Dm to the pixel unit 100. The data signals generated from the data driver 200 have voltage set for each gray level value, wherein the voltage set for each gray level value is determined by a gamma value. In other words, the gray level value is judged by the image signal R, G, and B data, and the voltage corresponding to the gray level value is determined by the gamma value so that the voltage of the data signal is determined.

The scan driver 300 receives a scan driving control signal SCS from the controller 400 to generate scan signals. Such a scan driver 300 is coupled to the scan lines S1, S2, . . . Sn−1, and Sn to transfer the scan signals to a specific row of the pixel unit 100. The pixel 101 transferred with (and received) the scan signal is transferred with (and received) the data signal output from the data driver 200 so that the voltage corresponding to the data signal is transferred to (and received by) the pixel 101.

The controller 400 senses the voltage input from a battery and then controls the voltage of the data signal and the voltage of the first power supply ELVDD and the voltage of the second power supply ELVSS to correspond with the input voltage, thereby controlling the brightness of the pixel unit 100.

The power supply unit 500 generates the first power of the first power supply ELVDD and the second power of the second power supply ELVSS by boosting or inverting the input voltage input from the external such as a battery, and transfers them to the pixel unit 100. Here, in one embodiment, the power supply unit 500 allows the voltage of the first power supply ELVDD and the voltage of the second power supply ELVSS (or the voltage between the first power supply ELVDD and the second power supply ELVSS) to correspond with the input voltage.

Figure 3:
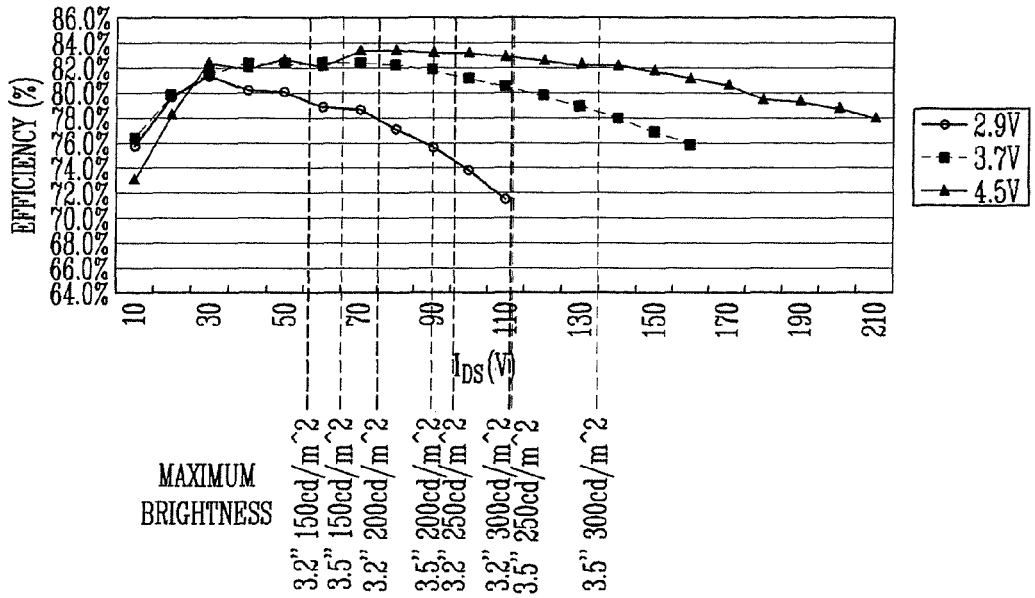
FIG. 3 is a graph showing the efficiency of a power supply unit for each input voltage.

FIG. 3 is a graph showing the efficiency of a power supply unit for each input voltage. The cases where the size of the pixel unit is 3 inches by 3.5 inches will be described by way of example. Referring to FIG. 3, the horizontal axis of the graph represents the amount of current that flows on the entirety of the pixel unit 100 and the vertical axis of the graph represents the efficiency, thereby showing the current flowing in the cases where the input voltage is 2.9V, 3.7V, and 4.5V, and the efficiency thereof.

In order that the pixel unit 100 has a maximum brightness of 300 cd/m$^2$, current of about 120 mA should be flowed in the case of the pixel unit 100 having the size of 3.2 inches and current of about 140 mA should be flowed in the case of the pixel unit 100 having the size of 3.5 inches. Here, when the input voltage is 2.9V, if the pixel unit 100 has brightness of 200 cd/m$^2$ or more irrespective of the size of the pixel unit 100, the efficiency thereof abruptly falls. However, when the input voltage is 3.7V or more, although the pixel unit 100 maintains brightness of 300 cd/m$^2$, the efficiency thereof is maintained at 78% or more.

Therefore, in order that the pixel unit 100 has brightness of 300 cd/m$^2$ and maintains the efficiency having at least a set or predetermined level, the input voltage should maintain about 3.7V or more. Therefore, if the input voltage fails to maintain 3.7V, the power supply unit 500 stops supply of the first power of the first power supply ELVDD and the second power of the second power supply ELVSS. In other words, the pixel unit 100 cannot display an image any further.

However, if the pixel unit 100 has brightness of 200 cd/m$^2$ or less, although the input voltage is about 2.9V, the efficiency is at 75% or more.

In other words, if the brightness of the pixel unit 100 is lowered to be 200 cd/m$^2$ or less, the input voltage of 2.9V can be utilized.

Here, it should be noted that a battery outputs a high voltage after the charge thereof is completed while being used and gradually outputs a low voltage. Therefore, in order that the pixel unit 100 has brightness of 300 cd/m$^2$, the battery should output voltage of at least 3.7V, however, in order that the pixel unit 100 has brightness of 200 cd/m$^2$, the battery may output voltage of at least 2.9V. In other words, the battery has a lower voltage as time elapses so that a battery use time (or the lifespan of the battery) when the voltage of at least 2.9V is used becomes longer than a battery use time when the voltage of at least 3.7V is used.

In other words, when the battery voltage is fallen to 2.9V or less by measuring the battery voltage, if the brightness of the pixel unit 100 is lowered to 200 cd/m$^2$, the efficiency thereof is not fallen. Therefore, low input voltage Vin can be used so that the battery use time is increased.

Figure 4:
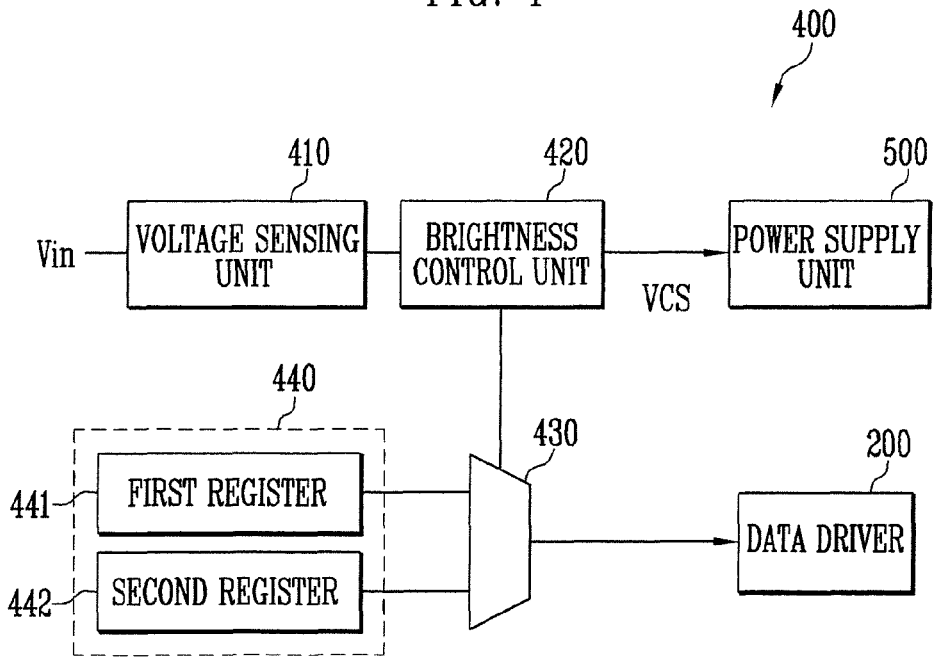
FIG. 4 is a schematic structure diagram showing the structure of the controller of FIG. 2.

FIG. 4 is a schematic structure diagram showing the structure of the controller of FIG. 2. Referring to FIG. 4, the controller includes a voltage sensing unit 410, a brightness control unit 420, a selection unit 430, and a gamma storage unit 440.

The voltage sensing unit 410 senses the input voltage Vin output from the battery and transfers to the power supply unit 500 to allow the input voltage Vin to correspond to the voltage that is lowered according to the battery use time. Here, the input voltage Vin output from the battery is frequently varied according to the load of the organic light emitting display device that receives voltage from the battery. Therefore, if the voltage sensing unit 410 measures the input voltage Vin corresponding to the change for a short time period, it will lead to a frequent brightness change so that it may have an influence on the image quality. Therefore, the input voltage Vin to be input is sampled at several time periods and then, the noise thereof is removed using a suitable median filter, etc.

The brightness control unit 420 allows the brightness value corresponding to the input voltage Vin to be stored and allows the brightness value of the pixel unit 100 to correspond to the input voltage. In other words, if the input voltage Vin is a set (or predetermined) voltage or more, the brightness control unit 420 allows the brightness to be set to a first brightness, and if the input voltage Vin is a set (or predetermined voltage) or less, the brightness control unit 420 allows the brightness to be set to a second brightness. That is, in one embodiment, if the input voltage Vin is a first set voltage or more, the brightness control unit 420 allows the brightness to be set to the first brightness, and if the input voltage Vin is a second set voltage or less, the brightness control unit 420 allows the brightness to be set to the second brightness. In another embodiment, if the input voltage Vin is not less than a set voltage, the brightness control unit 420 allows the brightness to be set to the first brightness, and if the input voltage Vin is less than the set voltage, the brightness control unit 420 allows the brightness to be set to the second brightness. In yet another embodiment, if the input voltage Vin is greater than a set voltage, the brightness control unit 420 allows the brightness to be set to the first brightness, and if the input voltage Vin is not greater than the set voltage, the brightness control unit 420 allows the brightness to be set to the second brightness.

Also, according to the first brightness or the second brightness, the voltage control signal VCS corresponding thereto is transferred to the selection unit 430 and the power supply unit 550.

Also, in order to prevent the voltage sensing unit 410 from being too sensitive to the variation of the input voltage Vin that is varied according to the change of load, the brightness control unit 420 sets the set (or predetermined) values that are set to the first brightness and the second brightness to be different when the input voltage Vin is lowered from a high voltage operation to a low voltage operation and when the input voltage is raised from the low voltage operation to the high voltage operation. In other words, when the input voltage Vin is lowered from 3.7V to 2.8V, if the input voltage Vin is lowered to 2.9V by setting the voltage having a set or predetermined value to be about 2.9V, the brightness is changed from the first brightness to the second brightness. However, when the input voltage Vin is raised from 2.8V or less to 3.7V, if the input voltage Vin reaches 3.3V by setting the voltage having a set or predetermined value to be about 3.3V, the brightness is changed from the second brightness to the first brightness. Thereby, the brightness control unit 420 prevents the brightness from being too sensitively controlled.

The selection unit 430 allows any one of a first gamma value or a second gamma value stored in the gamma storage unit 440 corresponding to the voltage control signal VCS transferred from the brightness control unit 420 to be transferred to the data driver 200.

The gamma storage unit 440 includes a first register 441 in which the first gamma value is stored and a second register 442 in which the second gamma value is stored. Also, the gamma values stored in the first register 441 and the second register 442 are transferred to the data driver 200 by the selection unit 430. In addition, if the first gamma is selected, the data driver 200 outputs the data signal having a maximum brightness of about 300 cd/m$^2$, and if the second gamma value is selected, the data driver 200 outputs the data signal having a maximum brightness of about 200 cd/m$^2$.

Figure 5:
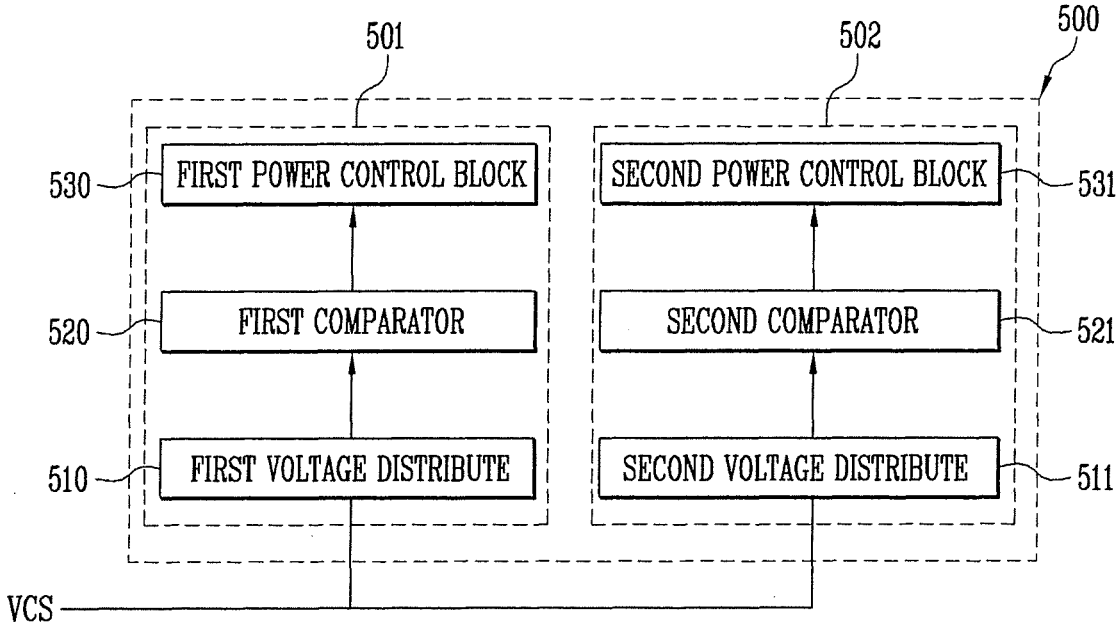
FIG. 5 is a schematic block diagram showing the structure of the power supply unit of FIG. 2.

FIG. 5 is a schematic block diagram showing the structure of the power supply unit of FIG. 2. Referring to FIG. 5, the power supply unit 500 includes a first power generation unit that generates the first power of the first power supply ELVDD and a second power generation unit that generates the second power of the second power supply ELVSS. Also, the power supply unit 500 is operated corresponding to the voltage control signal VCS generated from the brightness control unit 420.

The first power generation unit 501 includes a first voltage distributor 510, a first comparator 520, and a first power control block 530. The first voltage distributor 510 distributes the voltage of the voltage control signal VCS output from the brightness control unit 420. Also, the first comparator 520 compares the voltage distributed by the first voltage distributor 510 with a reference voltage (e.g., a first reference voltage) to determine whether the first gamma value or the second gamma value is selected. In addition, by the output of the first comparator 520, the first power control block 530 outputs the voltage of the first power supply ELVDD from which the brightness suitable for the first gamma value or the second gamma value can be output.

The second power generation unit 502 includes a second voltage distributor 511, a second comparator 521, and a second power control block 531. The second power distributor 511 distributes the voltage of the voltage control signal VCS output from the brightness control unit 420. Also, the second comparator 521 compares the voltage distributed by the second voltage distributor 511 with a reference voltage (e.g., a second reference voltage) to determine whether the first gamma value or the second gamma value is selected. In addition, by the output of the second comparator 521, the second power control block 531 outputs the voltage of the second power supply ELVSS from which the brightness suitable for the first gamma value or the second gamma value can be output.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display device, comprising:

a pixel unit configured to display images corresponding to a data signal, a scan signal, a first power, and a second power;

a data driver configured to receive an image signal to output the data signal;

a scan driver configured to output the scan signal;

a power supply unit configured to generate the first power and the second power; and a controller configured to output a voltage control signal in response to a voltage level of an input power from an external source to the power supply unit to control a voltage of the first power and a voltage of the second power, and select one of a first gamma value stored in a first register and a second gamma value stored in a second register in accordance with the voltage control signal to maintain a brightness of the displayed images when the first gamma value is selected and to decrease the brightness of the displayed images when the second gamma value is selected, wherein the power supply unit comprises a first power generation unit configured to generate the first power and a second power generation unit configured to generate the second power, and wherein the first power generation unit comprises a first voltage distributor configured to distribute the voltage of the voltage control signal, a first comparator configured to compare the voltage distributed by the first voltage distributor with a first reference voltage, and a first power control block configured to generate and output the voltage of the first power in accordance with an output value from the first comparator; and wherein the second power generation unit comprises a second voltage distributor configured to distribute the voltage of the voltage control signal, a second comparator configured to compare the voltage distributed by the second voltage distributor with a second reference voltage, and a second power control block configured to generate and output the voltage of the second power in accordance with an output value from the second comparator.

2. The organic light emitting display device as claimed in claim 1, wherein the controller includes:

a voltage sensing unit configured to sense the voltage of the input power;

a brightness control unit configured to output the voltage control signal to correspond to the voltage of the input power;

a gamma storage unit comprising the first register configured to store the first gamma value and the second register configured to store the second gamma value; and a selection unit configured to select a selected gamma value selected from the first gamma value and the second gamma value in accordance with the voltage control signal and to transfer the selected gamma value to the data driver.

3. The organic light emitting display device as claimed in claim 2, wherein the voltage sensing unit comprises a median filter configured to measure the voltage of the input power.

4. The organic light emitting display device as claimed in claim 2, wherein the brightness control unit is configured to select the first gamma value when the voltage of the input power is higher than a set voltage, and selects the second gamma value when the voltage of the input power is lower than the set voltage.

5. The organic light emitting display device as claimed in claim 4, wherein the set voltage has different magnitudes when the voltage of the input power is lowered from a high voltage operation to a low voltage operation and when the voltage of the input power is raised from the low voltage operation to the high voltage operation.

6. The organic light emitting display device as claimed in claim 2, wherein the brightness control unit is configured to select the first gamma when the voltage of the input power is higher than a first set voltage, and selects the second gamma when the voltage of the input power is lower than a second set voltage.

7. The organic light emitting display device as claimed in claim 6, wherein the first set voltage is lower in level than the second voltage.

8. The organic light emitting display device as claimed in claim 7, wherein the first set voltage is for when the voltage of the input power is lowered from a high voltage operation to a low voltage operation and the second set voltage is for when the voltage of the input power is raised from the low voltage operation to the high voltage operation.

9. The organic light emitting display device as claimed in claim 1, wherein the data driver generates the data signal by utilizing the first gamma value or the second gamma value, and the image signal.

10. The organic light emitting display device as claimed in claim 1, wherein the first power generation unit comprises a first voltage distributor configured to distribute the voltage of the voltage control signal, a first comparator configured to compare the voltage distributed by the first voltage distributor with a reference voltage, and a first power control block configured to generate and output the voltage of the first power in accordance with an output value from the first comparator.

11. The organic light emitting display device as claimed in claim 1, wherein the second power generation unit comprises a second voltage distributor configured to distribute the voltage of the voltage control signal, a second comparator configured to compare the voltage distributed by the second voltage distributor with a reference voltage, and a second power control block configured to generate and output the voltage of the second power in accordance with an output value from the second comparator.

12. A driving method for an organic light emitting display device, the method comprising:

generating, by a power supply unit, a first power and a second power by utilizing an input power;

sensing a voltage level of the input power and generating a voltage control signal in response to the voltage level of the input power;

selecting one of a first gamma value stored in a first register and a second gamma value stored in a second register based on the voltage control signal;

maintaining a brightness of images displayed by a display panel when the first gamma value is selected and decreasing the brightness of images displayed by the display panel when the second gamma value is selected; and controlling a voltage of the first power and a voltage of the second power in accordance with the voltage control signal, wherein the power supply unit comprises a first power generation unit configured to generate the first power and a second power generation unit configured to generate the second power, and wherein the first power generation unit comprises a first voltage distributor configured to distribute the voltage of the voltage control signal, a first comparator configured to compare the voltage distributed by the first voltage distributor with a first reference voltage, and a first power control block configured to generate and output the voltage of the first power in accordance with an output value from the first comparator; and wherein the second power generation unit comprises a second voltage distributor configured to distribute the voltage of the voltage control signal, a second comparator configured to compare the voltage distributed by the second voltage distributor with a second reference voltage, and a second power control block configured to generate and output the voltage of the second power in accordance with an output value from the second comparator.

13. The driving method for the organic light emitting display device as claimed in claim 12, further comprising applying the first gamma value to voltage of a data signal when the voltage of the input power is higher than a set value and applying the second gamma value to the voltage of the data signal when the voltage of the input power is lower than the set value.

14. The driving method for the organic light emitting display device as claim 13, wherein a magnitude of the set value is set to be different when the voltage of the input power is changed from a high voltage operation to a low voltage operation and when the voltage of the voltage of the input power is changed from the low voltage operation to the high voltage operation.

* * * * *